US005632926A

United States Patent [19]

Dyer, Jr.

[11] Patent Number: 5,632,926

[45] Date of Patent: May 27, 1997

[54] SNOWMAN MOLD

[76] Inventor: Artega C. Dyer, Jr., 7 Giard Dr., Apt. 8, Baltimore, Md. 21207

[21] Appl. No.: 438,760

[22] Filed: May 10, 1995

[51] Int. Cl.[6] ..... B29C 33/26; B29C 33/44

[52] U.S. Cl. ..... 249/121; 249/126; 249/170; 249/171; 425/DIG. 57

[58] Field of Search ..... 249/126, 170, 249/39, 121, 171; 425/DIG. 57, 2; 264/222, DIG. 30

[56] References Cited

U.S. PATENT DOCUMENTS

| | | | |
|---|---|---|---|
| 83,210 | 10/1868 | Ripley | 249/170 |
| 954,368 | 4/1910 | Allison | 249/170 |
| 1,243,128 | 10/1917 | Baker | 249/170 |
| 1,635,093 | 7/1927 | McPherson et al. | 249/170 |
| 1,639,934 | 8/1927 | Ferring | 425/DIG. 57 |
| 2,198,634 | 4/1940 | Richter | 249/170 |
| 2,752,631 | 7/1956 | Wendt | 425/DIG. 57 |
| 3,059,279 | 10/1962 | Rossi | 249/126 |
| 4,164,341 | 8/1979 | McComb | 249/126 |
| 4,322,004 | 3/1982 | Schwuchow | 206/575 |
| 4,644,858 | 2/1987 | Liotto et al. | 249/170 |
| 4,725,036 | 2/1988 | Brandon et al. | 249/170 |
| 5,380,237 | 1/1995 | Kenyon | 446/491 |

*Primary Examiner*—Jan H. Silbaugh
*Assistant Examiner*—Mark Eashoo

[57] ABSTRACT

A snowman mold having a snowman mold cavity defined within a base member, a torso member, and a head member that are integral relative to one another, with each of the members having doors opened for access to the mold cavity permitting ease of removal of the mold structure relative to snow deposited within the mold cavity.

5 Claims, 3 Drawing Sheets

SNOWMAN MOLD

TECHNICAL FIELD

The field of invention relates to mold structure, and more particularly pertains to a showman mold wherein the same is arranged for receiving snow to define a showman shape. The mold may be positioned and remain in situ, or alternatively may be removed relative to the molded snow.

BACKGROUND OF THE INVENTION

Typically, snowmen constructed subsequent to snow is a procedure effected by the rolling of various balls of snow which are subsequently positioned in a vertically aligned relationship. The instant invention eliminates need to lift such balls of snow which may result in various physical injury to individuals and to this end, the instant invention substantially fulfills this need.

SUMMARY OF THE INVENTION

The snowman mold of the invention includes a plurality of sections that are integral relative to one another, but each including relative door structure to permit the removal of the mold structure or alternatively maintain the mold structure in place.

Objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

DESCRIPTION OF THE PREFERRED EMBODIMENT

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Figure 1:
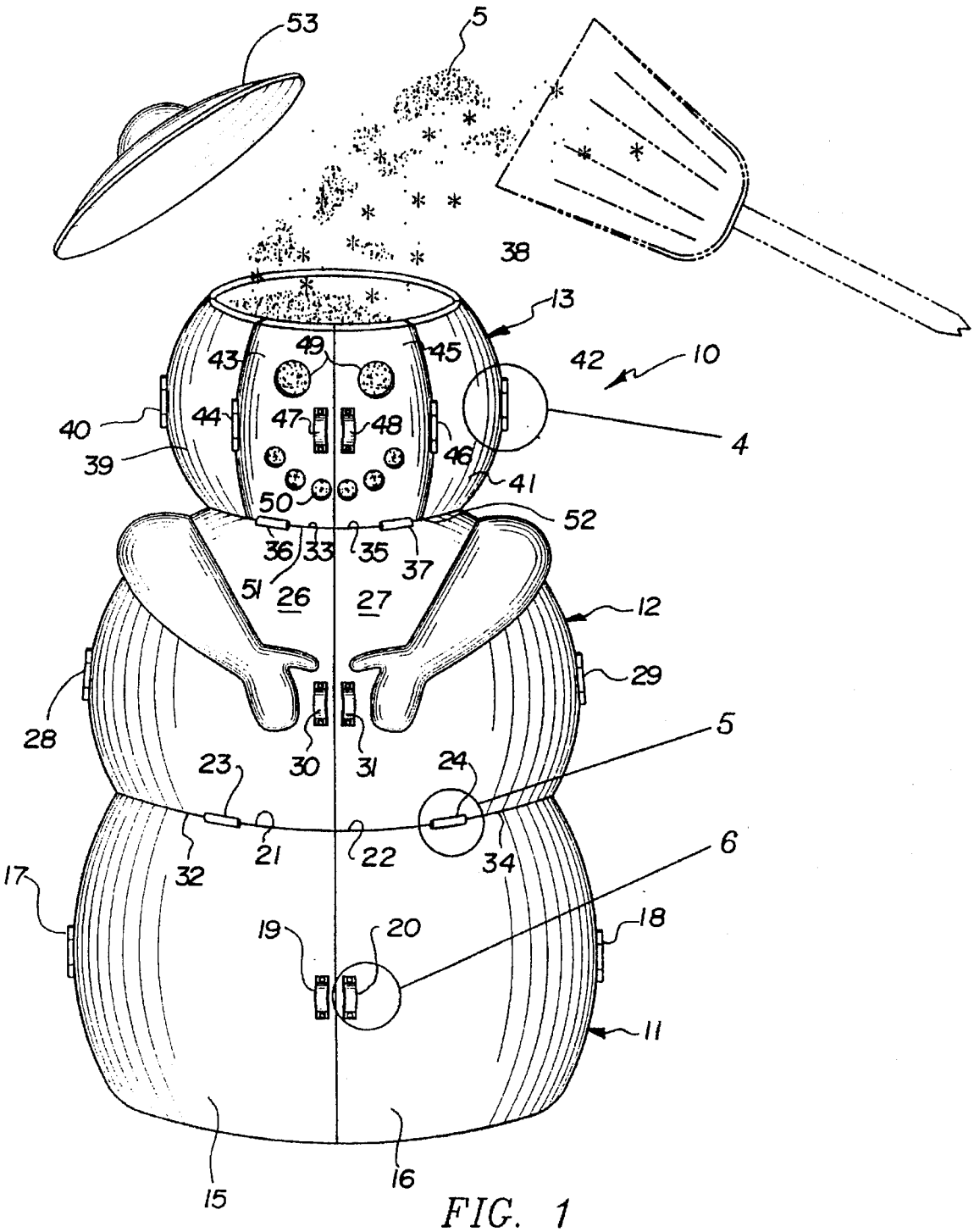
FIG. 1 is a perspective illustration of the invention in use.
Figure 2:
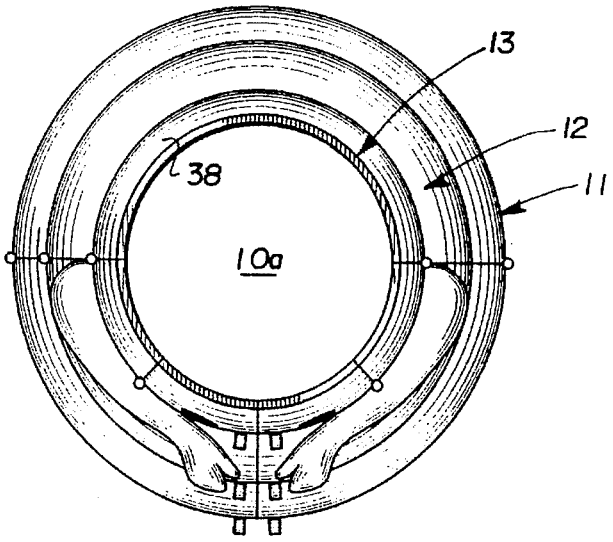
FIG. 2 is a top plan view of the invention with the hat or plate structure removed therefrom.

The snowman mold 10 of the invention, such as indicated in FIG. 1, is arranged to include a base member 11 integral with a torso member 12 that in turn is integral to a head member 13 defining a mold cavity 10*a* (see FIG. 2), such that the base member 11 defines a base cavity in communication with a torso cavity of the torso member 12, that in turn is in communication with the head cavity of the head member 13. A hat plate 53 is arranged for positioning upon an upper periphery of the head member 13 to enclose the mold cavity 10*a* when the snowman mold 10 is maintained about snow "S" filled within the mold cavity 10*a* utilizing a conventional shovel, such as indicated in phantom, or any other such implement as desired.

The base member 11 is provided with a base rear wall 14 having respective first and second doors 15 and 16 hingedly mounted about respective first and second hinges 17 and 18 to respective first and second ends of the base rear wall 14. The first door 15 is provided with a first handle 19 and the second door 16 is provided with a second handle 20 arranged for ease of manual manipulation of the respective first and second doors 15 and 16. The first door is provided with a first door upper edge 21, while the second door is provided with a second door upper edge 22, having respective first and second resilient lugs 23 and 24 integral therewith extending somewhat beyond and above the first and second door upper edges 21 and 22 to engage and maintain in a closed relationship the doors of the torso member 12 in a secure enclosed relationship. If so desired, the torso doors may be displaced past the resilient lugs 23 and 24 if so deemed necessary, but otherwise the lug structures 23 and 24 maintain the torso doors in a closed configuration, such as illustrated in FIG. 1.

Figure 3:
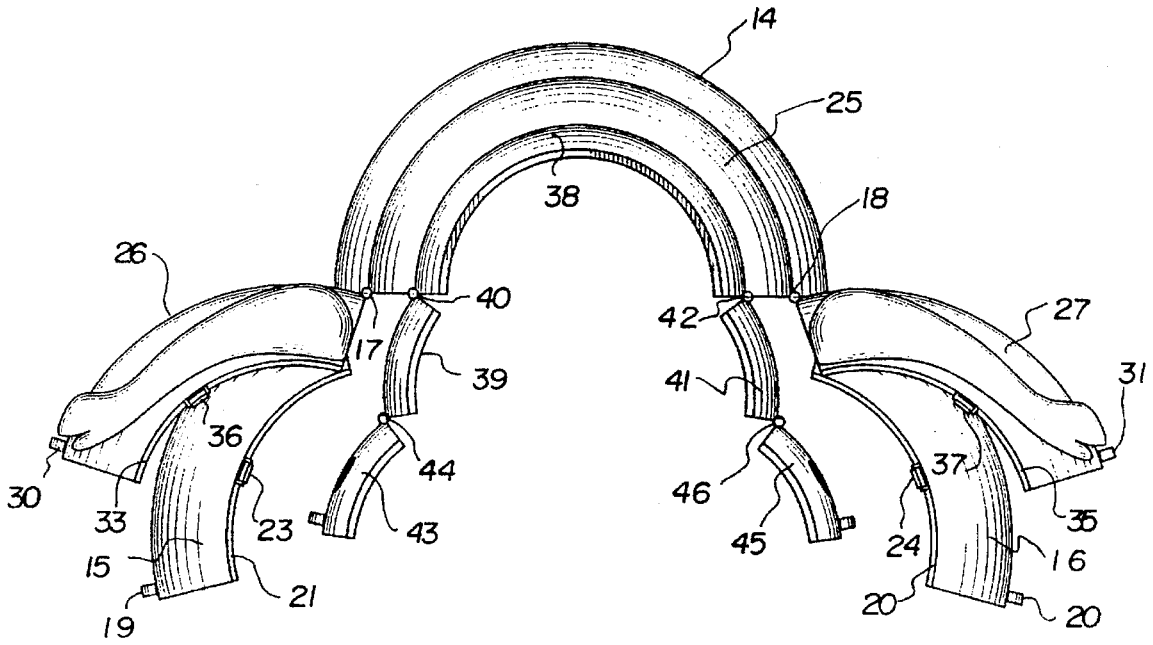
FIG. 3 is a top plan view of the invention, as indicated in FIG. 2, with the various sections in an opened configuration to permit removal of the mold structure.
Figure 4:
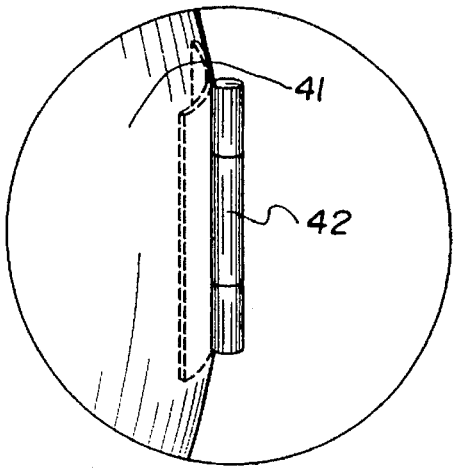
FIG. 4 is an enlarged perspective illustration of section 4 as set forth in FIG. 1.
Figure 5:
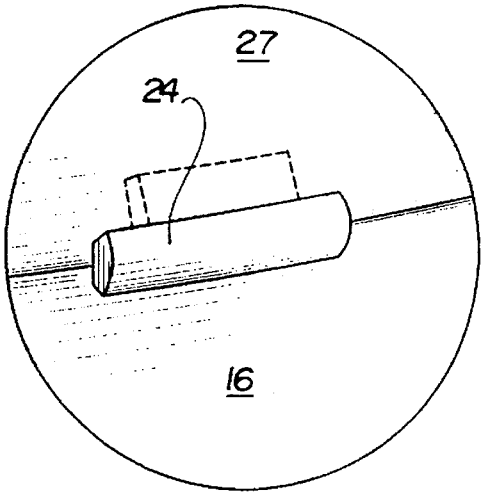
FIG. 5 is an enlarged perspective illustration of section 5 as set forth in FIG. 1.
Figure 6:
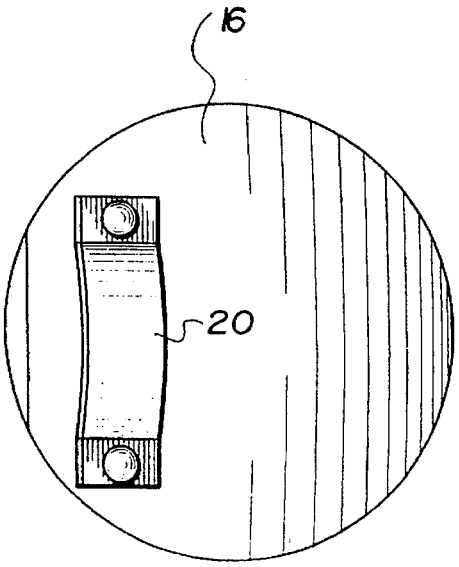
FIG. 6 is an enlarged perspective illustration of section 6 as set forth in FIG. 1.

The torso member 12 is provided with a torso rear wall 25 fixedly secured or otherwise integral to the base rear wall 14, such as illustrated in FIG. 3. The torso rear wall 25 is provided with respective third and fourth doors 26 and 27 hingedly mounted to opposed ends of the torso rear wall 25 about respective third and fourth hinges 28 and 29. It should be noted that the third and fourth doors may be provided with respective right and left arm members, such as illustrated, but which may be deleted if so desired. Respective third and fourth handles 30 and 31 are fixedly secured to exterior surfaces of the third and fourth doors 26 and 27 for ease of manual manipulation of the third and fourth doors 26 and 27. The third door is provided with a third door lower edge 32 spaced from a third door upper edge 33, while the fourth door 27 is provided with a fourth door lower edge 34 spaced from a fourth door upper edge 35. Respective third and fourth resilient lugs 36 and 37 are integral to the third and fourth door upper edges 33 and 35 extending somewhat beyond to maintain the head doors in a closed configuration, in a manner as noted relative to the description of the first and second resilient lugs 23 and 24 above.

The head member 13 is provided with a head rear wall 38 integral or otherwise fixedly secured to the torso rear wall 25. The head rear wall 38 includes respective fifth and sixth doors 39 and 41 hingedly mounted to opposed sides of the head rear wall 38 about respective fifth and sixth door hinges 40 and 42 respectively. Respective seventh and eighth doors 43 and 45 are hingedly mounted to the respective fifth and sixth doors 39 and 41 about respective seventh and eighth hinges 44 and 46. The seventh and eighth doors are provided with respective seventh and eighth door handles 47 and 48, with eye openings 49 and mouth openings 50 directed through each of the seventh and eighth doors. The eye and mouth openings 49 and 50 may have various components directed therethrough, such as carrots, coal, and the like to provide for various facial exaggerations of the snowman, or otherwise the fifth through eighth doors of the head member may be opened, in a manner such as illustrated in FIG. 3, to further permit ease of removal of the snowman mold structure relative to snow filled within the mold cavity 10*a*. The muffled door structure of the head member 13 is provided to enhance ease of filling and compacting of snow within the mold cavity and also permit only the facial features including the eye and mouth openings 49 and 50 to be opened relative to the head member 13 should various components such as coal and the like be positioned within the mold 10*a* for viewing through the eye and mouth openings 49 and 50.

The seventh door 43 is provided with a seventh door lower periphery 51 arranged to engage the third resilient lug 36, while the fourth resilient lug 37 is arranged to engage the eighth door lower periphery 52. The hat plate 53 may be mounted onto the upper periphery of the head member 13 subsequent to the filling procedure. Further it should be noted that the base member 11 is defined by a first width less than a second width of the torso member 12 that is typically of a lesser width than the third width of the head member 13. These dimensions may be changed, but are typically employed relative to desired proportions to define a snowman configuration.

It is to be understood that while certain forms of the present invention have been illustrated and described herein, it is not to be limited to the specific forms or arrangement of parts described and shown.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed and desired to be protected by LETTERS PATENT of the United States is as follows:

1. A snowman mold comprising, a base member, a torso member, and a head member, with the base member, torso member, and head member integral relative to one another, with the base member having a base member rear wall, the torso member having a torso member rear wall integral with the base member rear wall and the head member having a head member rear wall integral with the torso member rear wall, and the base member having first door means pivotally mounted to the base member rear wall for opening for access within the base member, the first door means including a first door and a second door hingedly mounted to opposed sides of the base member rear wall about respective first and second hinges, the torso member having second door means pivotally mounted to the torso member rear wall for opening for access within the torso member, the second door means including a third door and a fourth door hingedly mounted to opposed sides of the torso member rear wall about respective third and fourth hinges, and the head member having third door means pivotally mounted to the head member rear wall for opening for access within the head member, the third door means including a fifth door and a sixth door hingedly mounted to opposed sides of the head member rear wall about respective fifth and sixth hinges, wherein the base member, the torso member, and the head member define a mold cavity which defines a snowman shape when the first door means, the second door means, and the third door means are in a closed configuration, the door means configured to permit ease of removal of the mold relative to snow deposited within the mold cavity when the door means are in an open configuration.

2. A snowman mold as set forth in claim 1 wherein the third door means includes a seventh door hingedly mounted to the fifth door about a seventh hinge, and an eighth door hingedly mounted to the sixth door about an eighth hinge.

3. A snowman mold as set forth in claim 2 including a hat plate, the hat plate received on an upper periphery of the head member.

4. A snowman mold as set forth in claim 3 wherein the seventh door and the eighth door each includes at least one mouth opening and at least one eye opening.

5. A snowman mold as set forth in claim 4 wherein the first door includes a first door upper edge and the second door includes a second door upper edge, with the first door upper edge having a first resilient lug projecting beyond the first door upper edge, and the second door upper edge having a second resilient lug extending above the second door upper edge, with the first lug and the second lug arranged to engage a third door lower edge and a fourth door lower edge, the third door having a third door upper edge and the fourth door having a fourth door upper edge, the third door upper edge having a third resilient lug, the fourth door upper edge having a fourth resilient lug, with the third resilient lug and the fourth resilient lug arranged to engage the seventh door and the eighth door respectively.

* * * * *